US006306000B1

(12) United States Patent
Parten et al.

(10) Patent No.: US 6,306,000 B1
(45) Date of Patent: Oct. 23, 2001

(54) TOWING HARNESS FOR WATER RECREATION BOARDS

(75) Inventors: Keith C. Parten; Barton Napier, both of Fort Worth, TX (US)

(73) Assignee: Nash Manufacturing, Inc., Fort Worth, TX (US)

( * ) Notice: Subject to any disclaimer, the term of this patent is extended or adjusted under 35 U.S.C. 154(b) by 0 days.

(21) Appl. No.: 09/515,571

(22) Filed: Feb. 29, 2000

Related U.S. Application Data

(63) Continuation-in-part of application No. 08/942,470, filed on Oct. 29, 1997, now Pat. No. 6,042,439.
(60) Provisional application No. 60/174,196, filed on Jan. 2, 2000.

(51) Int. Cl.[7] ..... B63B 1/00
(52) U.S. Cl. ..... 441/65; 441/69; 441/74; 114/253
(58) Field of Search ..... 441/65, 74, 68, 441/69, 79; 114/357, 253

(56) References Cited

U.S. PATENT DOCUMENTS 2,735,115 * 2/1956 Dees ..... 441/65
2,928,109 * 3/1960 Wilber ..... 441/65
3,340,554 * 9/1967 Allender ..... 441/65
4,678,445 * 7/1987 Monreal ..... 441/65
5,797,779 * 8/1998 Stewart ..... 441/65

* cited by examiner

*Primary Examiner*—Stephen Avila
(74) *Attorney, Agent, or Firm*—Melvin A. Hunn; James E. Walton; Hill & Hunn, LLP

(57) ABSTRACT

A rigid water recreation board for towing behind a water vessel. There is an eyelet extending through the board. A rope is attached to the vessel and freely passes through the eyelet. A handle is attached to the rope and is dimensioned such that it may not pass through the eyelet. A rider may lie upon, kneel upon, or stand upon the board as it is being towed by the vessel. The rider has the option of holding onto the handle or letting the handle be pulled against the upper surface of the board while the board is in tow by the vessel. A towing harness is provided which ensures that force from the rope may be applied through the towing harness to each side of the rigid water recreation board in order to minimize the downward diving of the rigid water recreation board when it is towed with no rider thereon.

32 Claims, 10 Drawing Sheets

Fig. 1
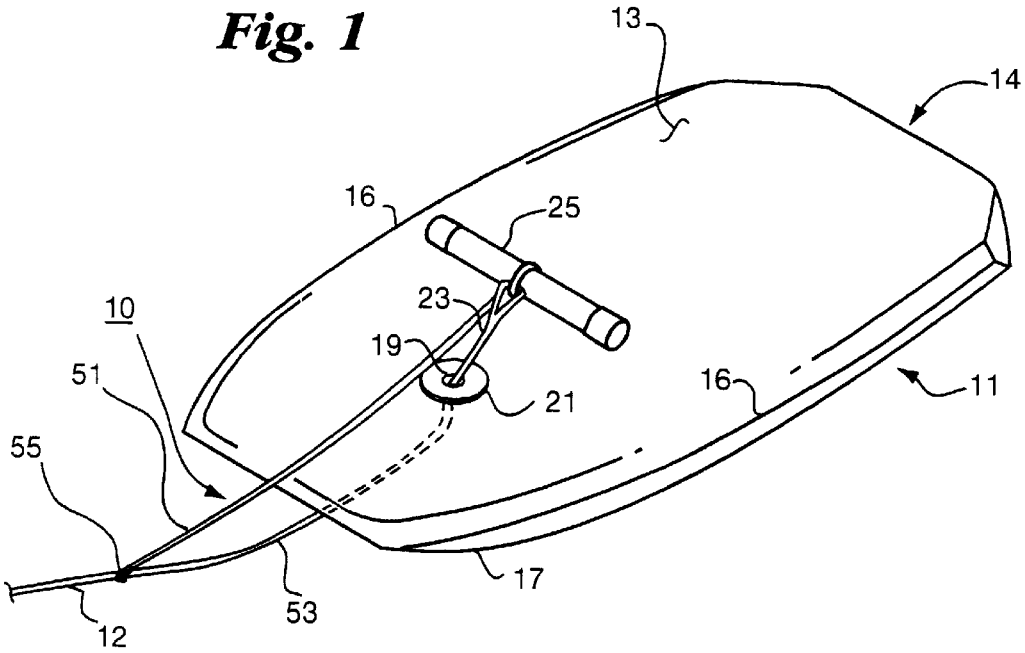
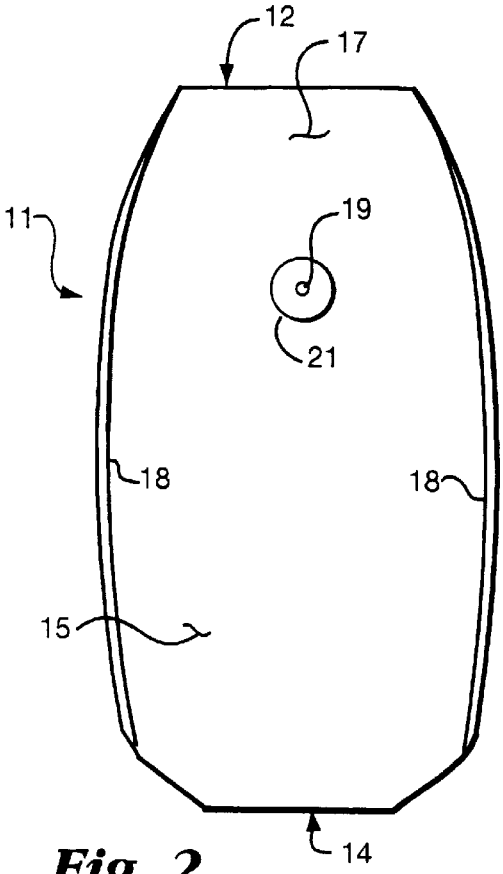
Fig. 2
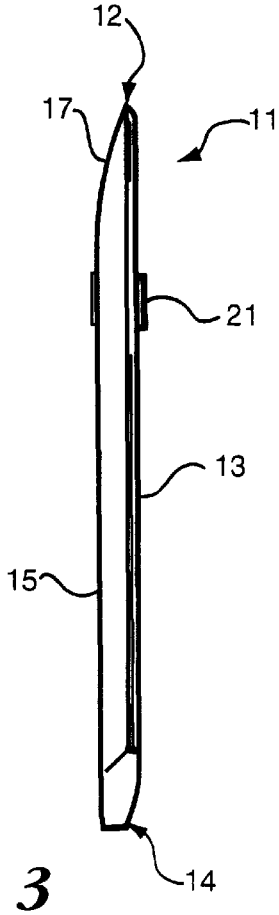
Fig. 3

TOWING HARNESS FOR WATER RECREATION BOARDS

CROSS-REFERENCE TO RELATED APPLICATIONS

This application claims the benefit of U.S. Provisional Application Serial No. 60/174,196, filed Jan. 2, 2000, entitled Improved Towing Harness for Water Recreation Boards, and is a continuation-in-part of U.S. patent application Ser. No. 08/942,470, filed Oct. 29, 1997, entitled Water Recreation Board with Pass-Through Tow Rope, now U.S. Pat. No. 6,042,439 issued Mar. 28, 2000.

BACKGROUND OF THE INVENTION

1. Field of the Invention

This invention relates to an improved towing harness for water recreation devices.

2. Background Information

Water recreation devices such as kick boards, water skis, knee boards, and surf boards have been around for a long time. Some are designed to be towed behind a boat or vessel and some are designed to be used by themselves in waves or currents. Kick boards and water skis have provided enjoyment for many years. Kick boards are generally used by swimmers for recreation or training. The swimmer can either hold the buoyant kick board out in front of himself or partially lie on the kick board to provide buoyancy while he kicks or trains. Water skis are an exciting way for a rider to stand up in the water and be towed by a boat or vessel at high speeds. Knee boards have made a more recent appearance on the water recreation scene. A rider kneels on the buoyant knee board and pulls a strap over his lap. The knee board rider can then be pulled by a boat or jet ski as he holds onto a tow rope. Surfers enjoy riding surf boards in many different positions, but generally, surf boards are not towed behind any sort of boat or vessel. Even though these recreational devices have been around for many years, their popularity has not diminished, in fact, many new models of each type are successfully introduced each year.

However, none of these devices combine the excitement and versatility of being towed by a boat or vessel and being able to ride the device in many different positions—or to spontaneously change riding positions—while retaining an option of either holding onto a tow rope, holding onto the device, or riding "hands-free." For example, none of these devices is designed to be pulled by a boat or vessel and to allow the rider to lie, sit, kneel, or stand on the device; however, the present invention does just that. It is a water recreation board that allows a rider to assume almost any position on the board—or to spontaneously change positions—and be towed by a boat or vessel, while maintaining an option of either holding onto a tow rope, holding onto the board, or riding hands-free and letting the tow rope pull the board.

The present invention is directed to an improved towing harness for pulling recreation boards behind a power boat or behind a jet-ski or similar craft. The improved towing harness is especially useful in combination with towable recreation boards which have a curved surface or other surface specialized for engaging the surface of the water, and an opposing surface for receiving the rider.

Such boards when flipped over during the towing will dive under the surface of the water and place tremendous force on the tow rope and the board itself. This can cause damage to the tow rope and/or the board. This can actually snap the board if the towing vessel is traveling fast enough.

The invention of the improved towing harness is especially useful in a specialty board which is the subject of the following co-pending patent application which is incorporated herein by reference as if fully set forth: U.S. patent application Ser. No. 081942,470, filed on Oct. 2, 1997, and which is entitled "Water Recreation Board With Pass Through Tow Rope", which is the invention of Keith Parten, a co-inventor of this application.

However, the utility of the present invention is not limited to this recreation device. It has equal utility with more conventional recreation boards which do not allow the tow rope to be freely passable through the body of the board, but which instead has a more fixed position or relationship between the tow rope and the recreation board itself.

SUMMARY OF THE INVENTION

It is the general object of the invention to provide an improved towing harness for use in combination with a water recreation device. In one embodiment this is achieved by providing a towing harness for use with a water recreation board with a pass-through rope. The water recreation board is a rigid board for towing behind a boat or vessel. The water recreation board has a tapered forward end, a chamfered aft end, a generally flat, rough upper surface, and a smooth lower surface. The lower surface is joined to the upper surface, and an upward-turning lip is integrated into the lower surface at the forward end of the board. The water recreation board has an eyelet passing through it from the lower surface to the upper surface. In the preferred embodiment, this is utilized to pass a portion of the towing harness which is attached to or integral with a tow rope which is attached at one end to a boat or vessel. A portion of the towing harness passes through the eyelet from the lower surface of the board to the upper surface of the board, and attaches to a handle at the opposite end. The tow rope and/or towing harness is free to pass through the eyelet unrestricted until the handle comes into contact with the upper surface of the board. The improved towing harness further limits the amount of length that the tow rope may be pulled through the board. However, this is not the purpose of the improved towing harness of the present invention. The purpose of the harness is to ensure that at least a portion of the improved towing harness engages each side of the recreation board in order to prevent downward diving of the board after the rider falls off of or releases his or her grip on the board or tow rope.

The present invention has utility in combination with such a board which allows a rider to lie, kneel, sit, or stand on the board as it is being towed by the boat or vessel. The rider has the option of holding onto the handle, holding onto the board, or riding hands-free and letting the handle be pulled against the upper surface while the board is in tow by the boat or vessel. The rider may change positions while riding the board.

However the improved towing harness of the present invention has utility with more conventional recreation boards, which will also be depicted and described herein.

BRIEF DESCRIPTION OF THE DRAWINGS

FIGS. 1 through 12 depict a first embodiment of the present invention while

FIG. 1 is a perspective view of the water recreation board with pass-through tow rope and the improved towing harness of the present invention.

FIG. 2 is a bottom view of the water recreation board of FIG. 1.

FIG. 3 is a left side view of the water recreation board of FIG. 1.

FIG. 4 is a perspective view of the first lying mode of operation of the present invention.

FIG. 5 is a perspective view of the second lying mode of operation.

FIG. 6 is a perspective view of the first sitting mode of operation.

FIG. 7 is a perspective view of the second sitting mode of operation.

FIG. 8 is a perspective view of the first kneeling mode of operation.

FIG. 9 is a perspective view of the second kneeling mode of operation.

FIG. 10 is a perspective view of the first standing mode of operation.

FIG. 11 is a perspective view of the second standing mode of operation.

FIG. 12 is a representation of one preferred means for connecting portions of the towing harness of the present invention to the handle.

FIGS. 13 and 14 are depictions of utilization of the towing harness of the present invention to more conventional boards.

FIGS. 15A and 15B depict the problems of the prior art that are avoided utilizing the present invention.

DESCRIPTION OF THE PREFERRED EMBODIMENT

Figure 4:
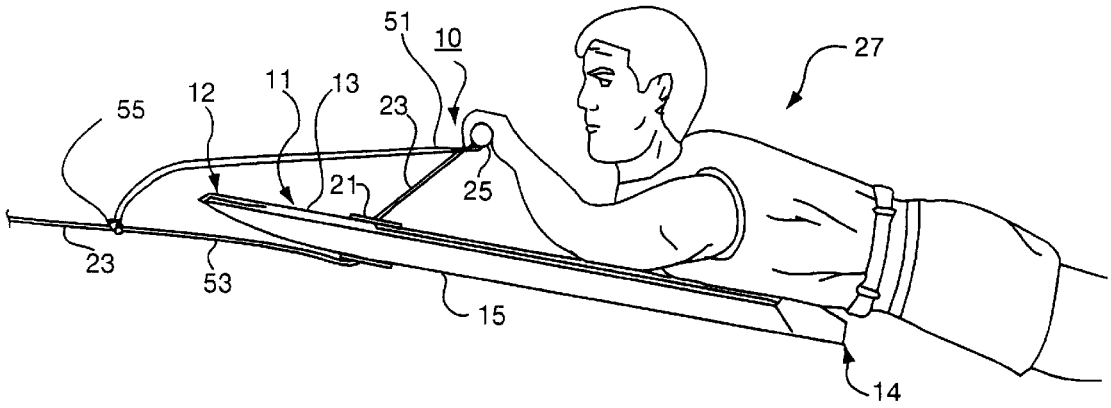

With reference now to the drawings, and in particular with reference to FIGS. 1, 2, and 3, the preferred embodiment of the improved towing harness 10 of the present invention is shown in use in combination with water recreation board 11.

Board 11 is a lightweight, wide board preferably made of a rigid foam material, such as polyethylene. Board 11 has a forward end 12 and an aft end 14. The corners of forward end 12 are preferably rounded, and the corners of aft end 14 are preferably chamfered. Board 11 has a generally flat upper surface 13, preferably with a rough finish, and a generally flat lower surface 15, preferably with a smooth finish. Upper surface 13 may be concave. Upper surface 13 has an upper peripheral edge 16, preferably rounded over. Lower surface 15 has a lower peripheral edge 18, preferably chamfered. Upper surface 13 and lower surface 15 are joined together at the intersection of upper peripheral edge 16 and lower peripheral edge 18. Lower surface 15 preferably has an upturned lip 17 at forward end 12 of board 11 to reduce drag, particularly in the initial stage of being towed by a boat or vessel (not shown).

At least one aperture 19 extends through board 11 from upper surface 13 toward lower surface 15. Each aperture 19 is lined with an eyelet 21, preferably made of rigid plastic or nylon.

A towing harness in accordance with the present invention may be utilized to connect a conventional tow rope form a boat to the board 11. Preferably the towing harness 10 includes one segment or portion 51 which engages the upper surface 13 of the board 11, and a second segment or portion which engages the lower surface 15 of the board 11. In the embodiment which is depicted in FIG. 1, the segments comprise portions of rope similar to tow rope 12. In the preferred embodiment, on of segments 51, 53 may comprise a continuation of tow rope 12. Alternatively, the segments may comprise separate pieces of rope which may be tied or bonded together. The view of FIG. 1 depicts such a coupling as knot 55.

The purpose of the harness 10 is to ensure that, if the board is flipped over when being towed, the board 11 will not dive downwardly under the water. As discussed above, tremendous forces are generated when a rider-less board is pulled under. Such forces are strong enough to snap a tow rope or crack, break, bend or other wise damage the board.

The segments 51, 53 are preferably formed form nylon ski rope, and one segment passes through eyelet 21 and is free to move therethrough without restriction until the towing harness 10 is pulled or extended fully upward. Rope 23 is adapted for attachment at one end to the vessel, and connects to the towing harness 10, which is adapted for attachment to a conventional handle 25 at the opposing end. Handle 25 is dimensioned such that it is larger than eyelet 21; therefore, attachment of handle 25 to rope 23 and towing harness 11 prevents rope 23 towing harness passing 10 form passing completely through eyelet 21 while board 11 is in tow.

In an alternate embodiment, lower surface 15 is formed and made smooth by adhering a thin sheet of material (not shown), preferably polyethylene or surlyn™, to lower surface 15.

Referring now to FIG. 4 through FIG. 11 in the drawings, eight different modes of operation of water recreation board 11 are illustrated. A rider 27 has an option of lying, sitting, kneeling, or standing on board 11. Regardless of the position rider 27 chooses, he or she also has an option of holding onto handle 25, holding onto board 11, or riding hands-free, that is, neither holding onto handle 25 nor board 11. If rider 27 chooses to ride either hands-free or holding onto board 11, handle 25 is pulled by the vessel toward upper surface 13 until handle 25 comes into contact with upper surface 13.

Figure 5:
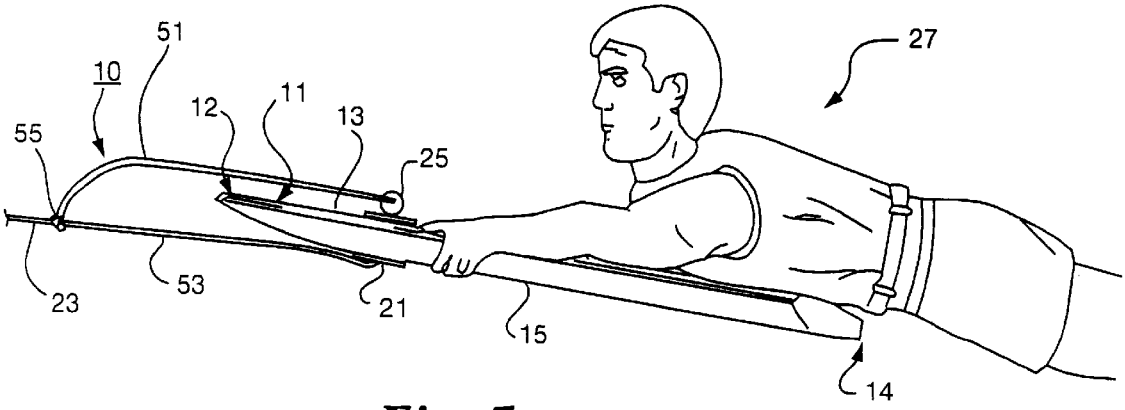
Figure 6:
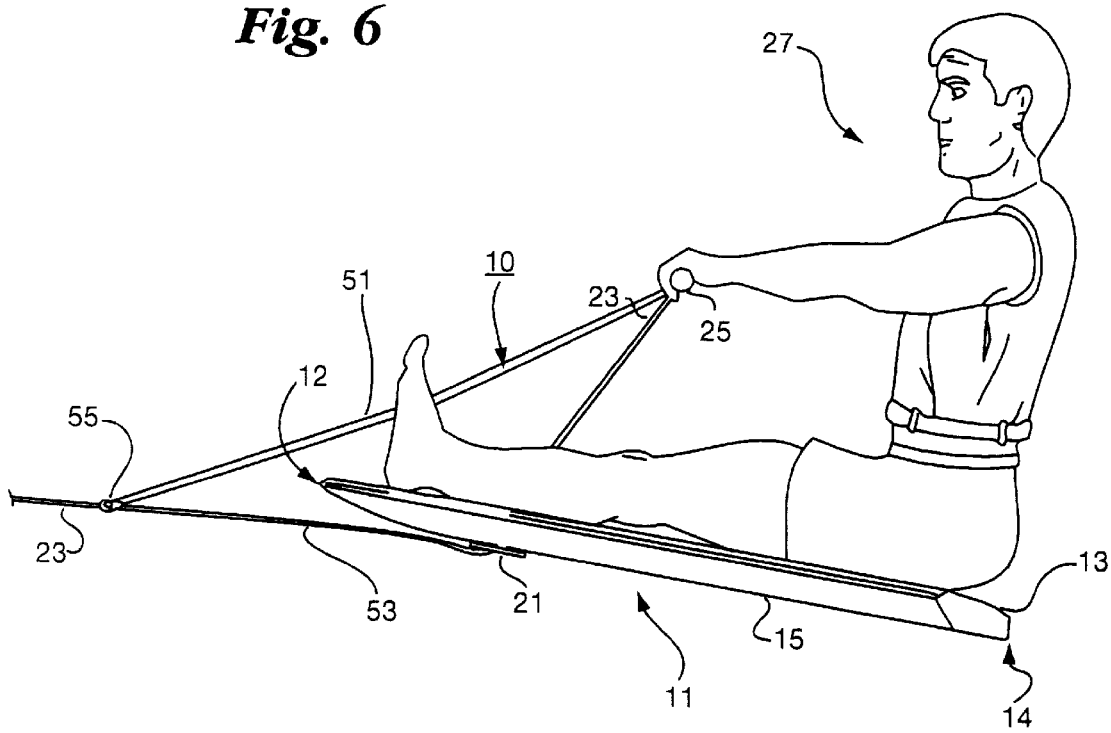
Figure 7:
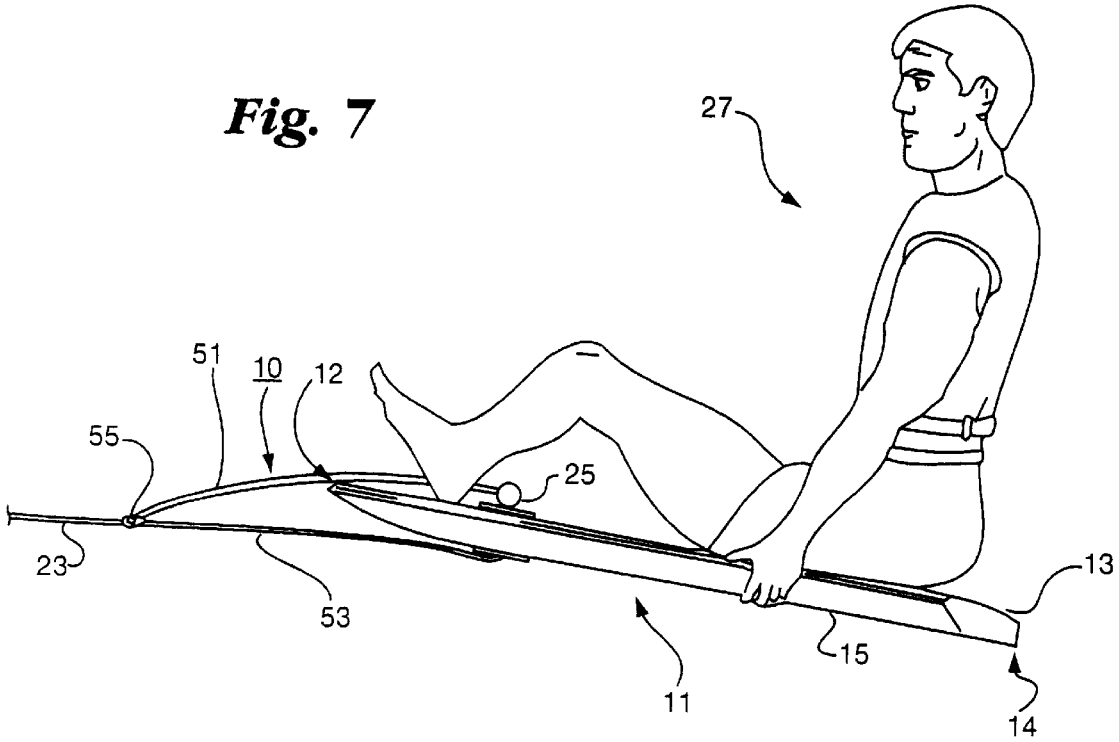
Figure 8:
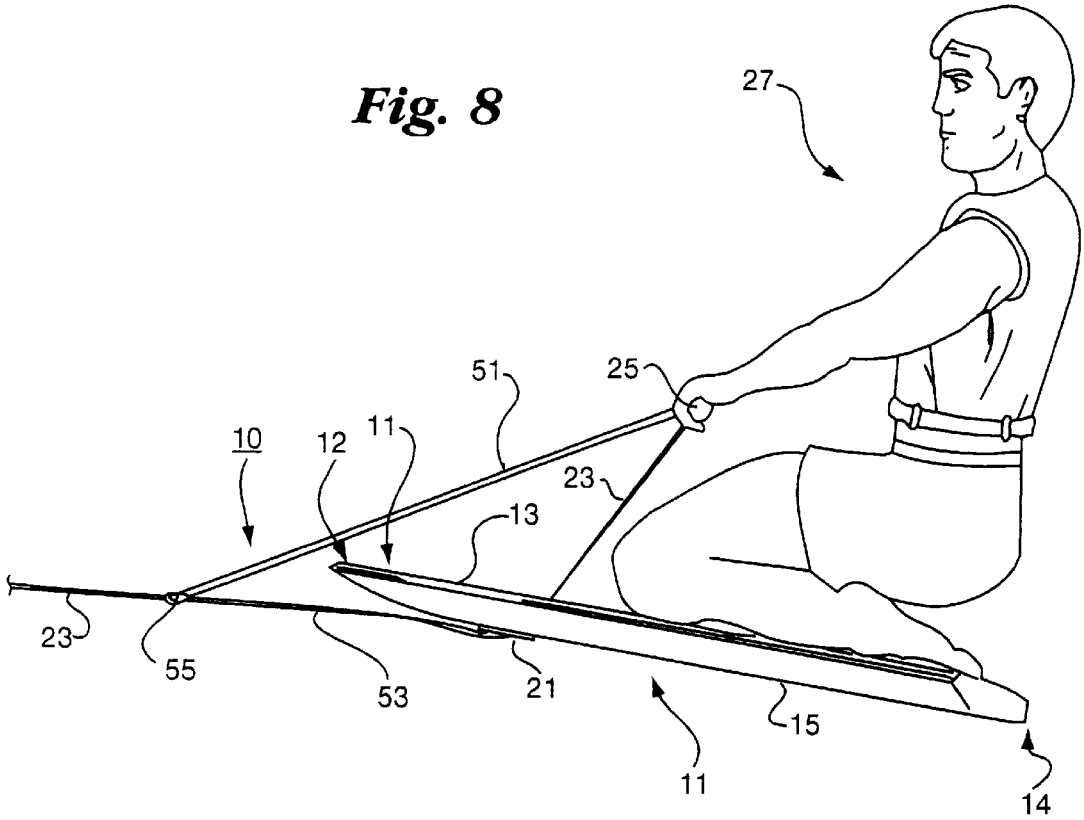
Figure 9:
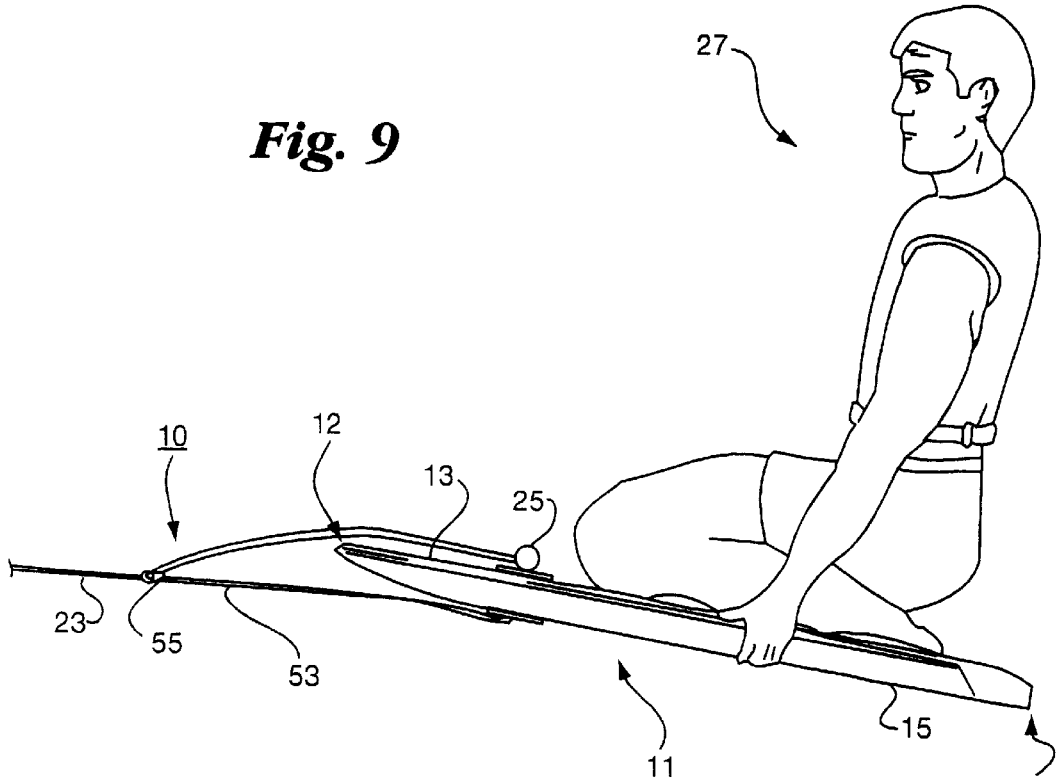
Figure 10:
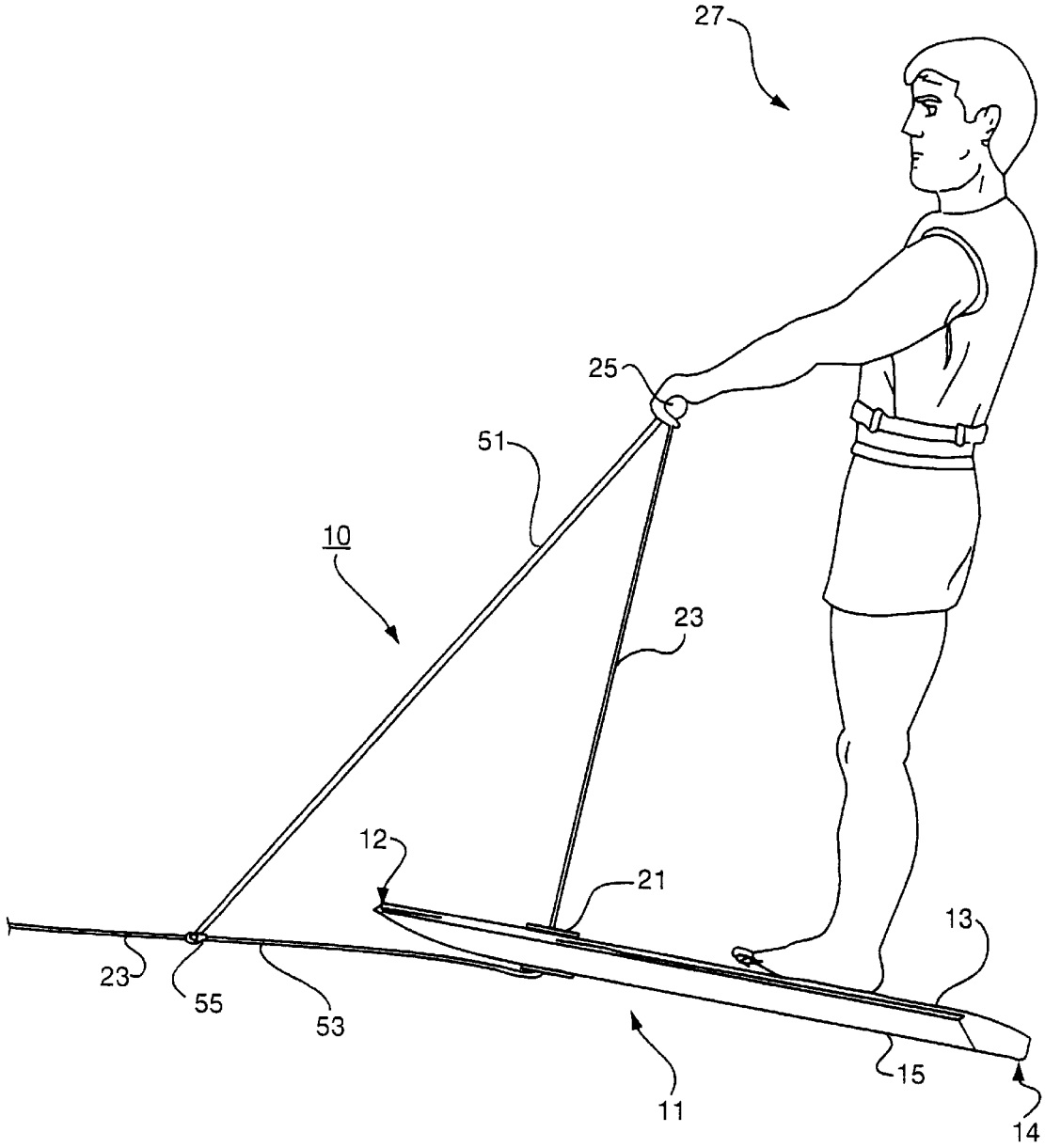
Figure 11:
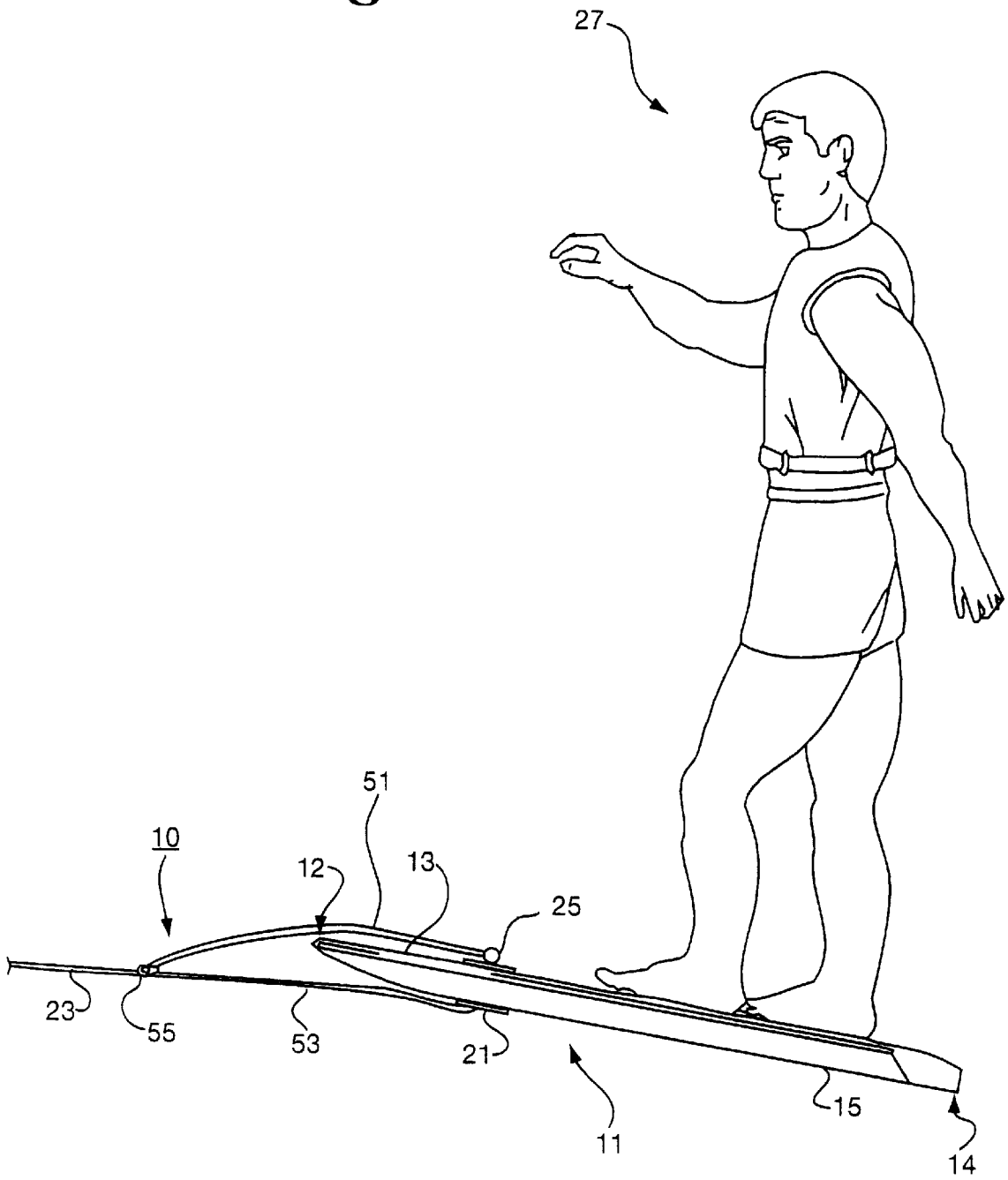

In FIG. 4, rider 27 operates board 11 in a first lying mode in which he lies on board 11 and holds onto handle 25. In FIG. 5, rider 27 operates board 11 in a second lying mode in which he lies on board 11 and holds onto board 11. In FIG. 6, rider 27 operates board 11 in a first sitting mode in which he sits on board 11 and holds onto handle In FIG. 7, rider 27 operates board 11 in a second sitting mode in which he sits on board 11 and holds onto board 11. In FIG. 8, rider 27 operates board 11 in a first kneeling mode in which he kneels on board 11 and holds onto handle 25. In FIG. 9, rider 27 operates board 11 in a second kneeling mode in which he kneels on board 11 and holds onto board 11. In FIG. 10, rider 27 operates board 11 in a first standing mode in which he stands on board 11 and holds onto handle 25. In FIG. 11, rider 27 operates board 11 in a second standing mode in which he stands on board 11 and rides hands-free.

Rider 27 may operate water recreation board 11 in any combination of the abovementioned modes, and is free to change modes during a ride. It is understood that rider 27 may employ other modes of operation not illustrated, such as riding on one knee, or lying on his back. It should be appreciated that the above-mentioned modes of operation that involve holding onto board 11 are particularly useful for riders 27 who are children or who lack sufficient strength to hold onto handle 25 during the initial stage of being towed by the vessel.

In operation, a vessel is provided and rope 23 is attached to the vessel by conventional means. Rope 23 is then coupled to the towing harness. One segment (such as segment 53) of the towing harness 10 is passed through eyelet 21 in a direction from lower surface 15 to upper surface 13.

Segment 53 is then attached to handle 25 by conventional means. Rider 27 mounts board 11 in a chosen mode of operation, and operates board 11 while being towed by the vessel.

Figure 12:
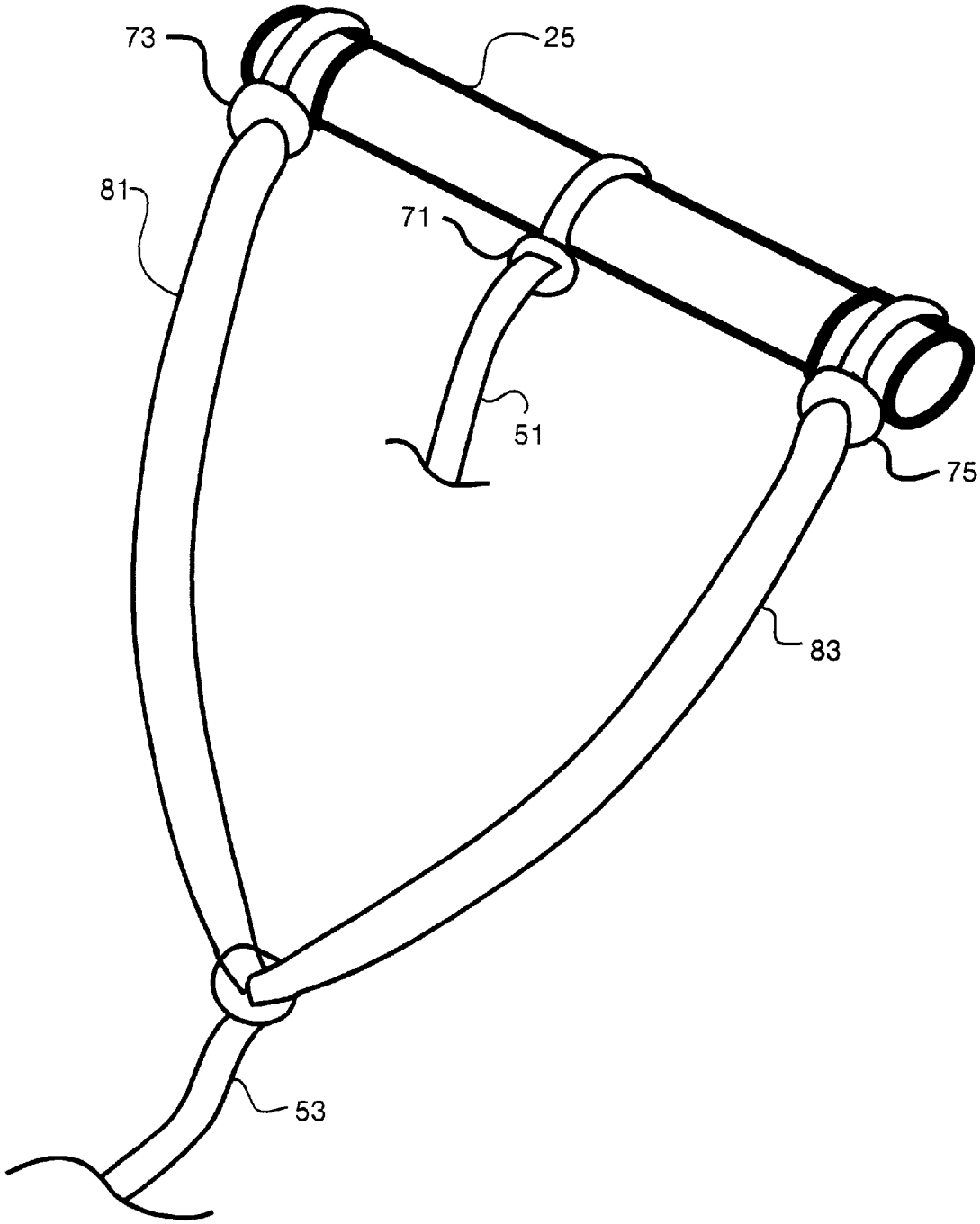

FIG. 12 depicts one preferred assembly for connection to handle 25. In this configuration, segment 51 passes over the top of the board 11 and couples to the handle 25 by wrapping around the handle 25 and being knotted, bonded, or otherwise secured. Segment 53 passes under the board 11 and through the eyelet. In this embodiment, segment 53 is split into two pieces 81, 83 which are each wrapped around and knotted, bonded, or secured to handle 25. This keeps the segments 51, 53 form being tangled.

In the preferred embodiment, the top segment (segment 51) is slightly longer than the other segment (segment 53) to allow the board to be pulled from the bottom (instead of the top side) while a rider is present which is the preferred direction of pull.

Figure 13:
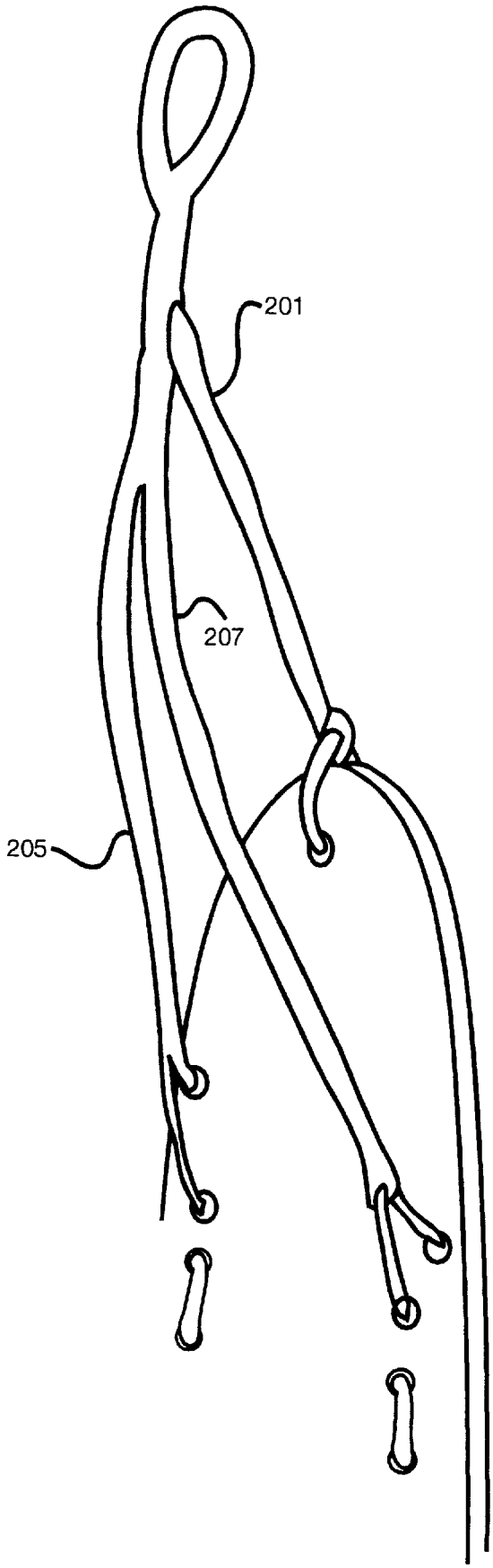
FIGS. 13 and 14 depict a second embodiment of the present invention.
Figure 14:
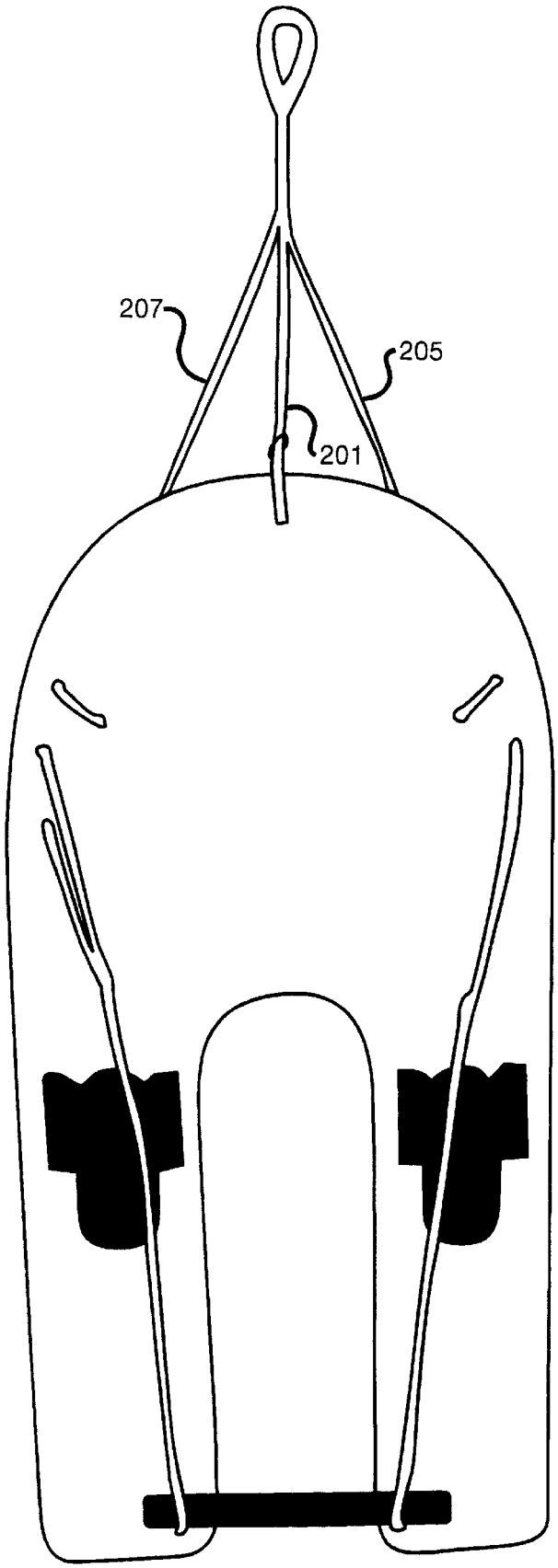

FIGS. 13 and 14 are depictions of the utilization of the present invention on more conventional boards which do not include any eyelets for passing the towing harness through the board. In FIG. 13, in accordance with the preferred embodiment of the present invention, a sort segment of rope 201 is shown as coupled to the top front end of the board by being passed through an anchoring hole and being knotted or bonded. Two towing lines or segments 205, 207 are shown as coupling to the board for use in conventional towing. Segment 201 serves to transfer force from the two rope to the board if the board flips and starts to dive. This force transfer will deter further diving and cause the board to remain at the surface of the water. FIG. 14 shows a similar towing harness utilized in a product known as a Ski Skimmer in a manner similar to that depicted in FIG. 13; accordingly, while the towing ropes pull form the bottom generally in order to allow hydroplaning, the segment 201 of the towing harness serves to prevent the board from diving if it flips and is towed without any rider present on the board.

Figure 15A:
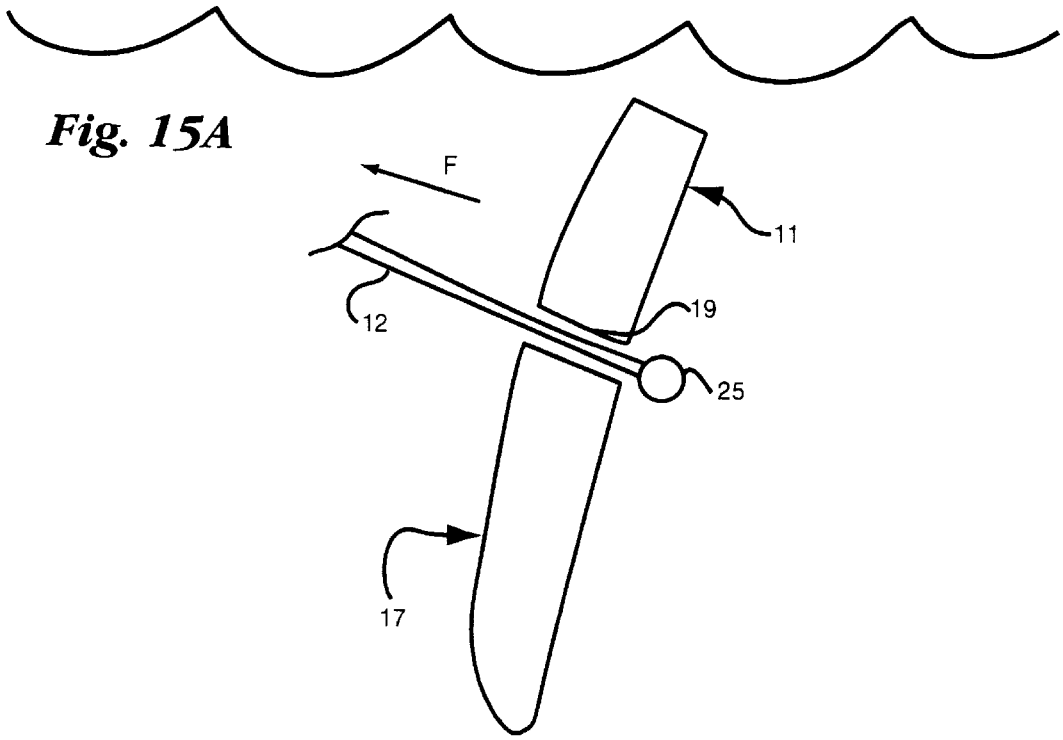
FIGS. 15A and 15B depict the problem that is avoided with the present invention.
Figure 15B:
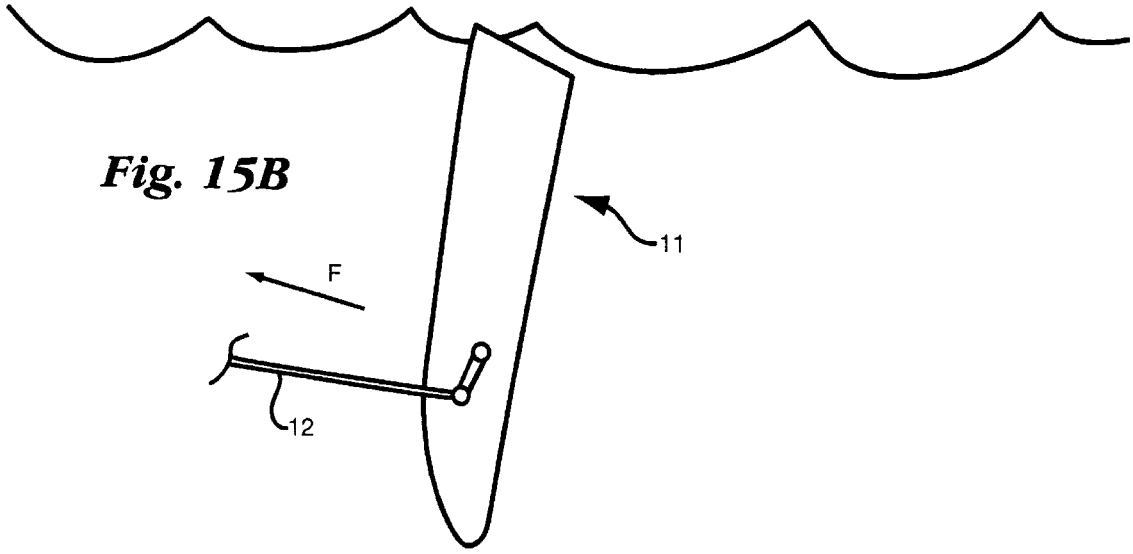

FIGS. 15A and 15B depict the problems of the prior art which are avoided or minimized with the present invention. FIG. 15A depicts a recreation board of the co-pending United States Patent Application which includes an eyelet which extends through the body 11 of the board. As is shown in this view the board 11 has flipped over in the water during towing operations. The rider has either fallen or released his or her hold on the board or tow row assembly. In this position the generally curved side is now facing the boat. The handle has now come into engagement with the relatively flat rider-side of the board 11. The tow rope 12 is now being pulled with great force F by the towing vessel. The board in this orientation is in a condition to continue the dive to a deeper level below the surface of the water 201. This situation places great force loads on the board 11. Such forces can cause tow rope 11 to snap or can break the board into several pieces.

FIG. 15B depicts a similar problem with a more conventional board. The board 11 has a towing rope 12 which is attached to the lower front portion of the board 11. If the board 11 flips over after the rider has fallen or released his or her hold, the board my dive and continue to dive due to the orientation. The towing vessel will pull with great force F which causes the board 11 to dive further and deeper. Such forces can snap the tow rope 12 or break board 11.

Although the invention has been described with reference to a preferred embodiment, this description is not to be construed in a limiting sense. Various modifications of the disclosed embodiment as well as alternative embodiments of the invention will become apparent to persons skilled in the art upon reference to the description of the invention.

What is claimed is:

1. A rigid water recreation board for towing behind a water vessel comprising:

a board portion;

an eyelet extending through the board portion;

a rope for attachment to the vessel, the rope freely passing through the eyelet;

a handle for attachment to the rope, the handle being dimensioned such that it is larger than the eyelet;

a towing harness for coupling the rope and board portion together in a configuration which minimizes downward diving of the board when there is no rider present on the board portion; wherein said rigid water recreation board is operable in at least the following modes of operation:

(a) a first prone mode, wherein a user lies face down on the board portion, the user further holding onto the handle;

(b) a second prone mode, wherein the user lies face down on the board portion, the user further allowing the handle to be pulled by the vessel until it makes contact with the board portion;

(c) a first kneeling mode, wherein a user kneels on the board portion, the user further holding onto the handle;

(d) a second kneeling mode, wherein the user kneels on the board portion, the user further allowing the handle to be pulled by the vessel until it makes contact with the board portion;

(e) a first sitting mode, wherein a user sits on the board portion, the user further holding onto the handle;

(f) a second sitting mode, wherein the user sits on the board portion, the user further allowing the handle to be pulled by the vessel until it makes contact with the board portion;

(g) a first standing mode, wherein a user stands on the board portion, the user further holding onto the handle; and (h) a second standing mode, wherein the user stands on the board portion, the user further allowing the handle to be pulled by the vessel until it makes contact with the board portion.

2. The water recreation board according to claim 1, wherein the board portion further comprises:

a generally flat upper surface;

an upper peripheral edge surrounding the upper surface;

a lower surface;

a lower peripheral edge surrounding the lower surface, the lower peripheral edge being joined to the upper peripheral edge; and an upward-tuning lip integrated into the lower surface, the lip being located at a forward end of the board.

3. The water recreation board according to claim 1, wherein the board is made from polyethylene.

4. The water recreation board according to claim 1, wherein the upper surface has a rough finish and the lower surface has a smooth finish.

5. The water recreation board according to claim 2, further comprising:

a thin sheet of smooth polyethylene adhered to the lower surface of the board; and the polyethylene sheet being further adhered to the lip.

6. The water recreation board according to claim 2, wherein the upper surface is concave.

7. The water recreation board according to claim 2, wherein a rider of the board may lie upon, kneel upon, sit upon, or stand upon the board as it is being towed by the vessel, the rider having an option of holding onto the handle or letting the handle be pulled by the vessel against the upper surface while the board is in tow by the vessel.

8. A water recreation board according to claim 1, wherein said towing harness interconnects said rope, said handle, and said board in a configuration which ensures that at least a portion of the rope or towing harness engages the upper generally flat surface and the lower surface of the board at the front end of the board.

9. A water recreation board according to claim 8, wherein said towing harness includes a first segment which passes under the board through the eyelet and is coupled to said handle and a second segment which passes over the front end of the board and is coupled to said handle.

10. In a water recreation board for towing behind a water vessel, the improvement comprising:

a board portion;

an eyelet extending through the board portion;

a rope for attachment to the vessel, the rope freely passing through the eyelet;

a handle for attachment to the rope, the handle being dimensioned such that it is larger than the eyelet; and a towing harness for allowing force transfer to each side of the board portion to prevent downward diving of the board portion when it is being towed with no rider thereon.

11. The water recreation board according to claim 10, wherein a rider of the water recreation board may lie upon, kneel upon, sit upon, or stand upon the board portion as it is being towed by the vessel, the rider having an option of holding onto the handle or letting the handle be pulled by the vessel against the board portion while the water recreation board is in tow by the vessel.

12. The water recreation board according to claim 10, wherein the board portion includes:

a tapered forward end;

a chamfered aft end;

a concave upper surface;

a flat lower surface joined to the upper surface;

an upward-turning lip integrated into the lower surface at the forward end of the board;

a rope for attachment to the vessel, the rope passing freely through the eyelet; and a handle for attachment to the rope, the handle being dimensioned such that it is larger than the eyelet.

13. A rigid water recreation board for towing behind a water vessel, the water recreation board having a tapered forward end, a chamfered aft end, a rough upper surface, the upper surface being concave, a smooth lower surface, the lower surface being joined to the upper surface, and an upward-turning lip integrated into the lower surface at the forward end of the board, the water recreation board comprising:

a board portion;

an eyelet extending through the board portion from the lower surface toward the upper surface; and a tow rope adapted for attachment to the vessel at one end and adapted for attachment to a handle at the opposite end, the tow rope passing from the vessel, through the eyelet in a direction from the lower surface to the upper surface, to the handle, the tow rope being free to pass through the eyelet, the handle being dimensioned such that it is larger than the eyelet;

wherein a rider may lie upon, kneel upon, sit upon, or stand upon the board as it is being towed by the vessel, the rider having an option of holding onto the handle or letting the handle be pulled against the upper surface while the board is in tow by the vessel; and a towing harness which allows force transfer from the rope to each side of the board portion to lessen the chance of the board diving downward while being towed while no rider is present thereon.

14. A method of water recreation comprising the steps of:

providing a water vessel;

providing a rigid board for towing by the vessel, the board having an upper surface and a lower surface;

providing an eyelet extending through the board;

providing a handle, the handle being dimensioned such that it will not pass through the eyelet;

providing a rope adapted for attachment to the vessel;

passing the rope through the eyelet in a direction from the lower surface to the upper surface;

attaching the rope to the handle;

providing a towing harness;

attaching the towing harness to the handle also;

towing the board with the vessel;

operating the board in a mode of operation; and when towing in a riderless condition, utilizing said towing harness to transfer force from the rope to the rigid board to minimize harmful downward diving of the rigid board.

15. The method according to claim 14, wherein the mode of operation comprises at least:

(a) a first lying mode, wherein a user lies face down on the board, the user further holding onto the handle;

(b) a second lying mode, wherein the user lies face down on the board, the user further allowing the handle to be pulled by the vessel until it makes contact with the board;

(c) a first kneeling mode, wherein a user kneels on the board, the user further holding onto the handle;

(d) a second kneeling mode, wherein the user kneels on the board, the user further allowing the handle to be pulled by the vessel until it makes contact with the board;

(e) a first sitting mode, wherein a user sits on the board, the user further holding onto the handle;

(f) a second sitting mode, wherein the user sits on the board, the user further allowing the handle to be pulled by the vessel until it makes contact with the board;

(g) a first standing mode, wherein a user stands on the board, the user further holding onto the handle; and (h) a second standing mode, wherein the user stands on the board, the user further allowing the handle to be pulled by the vessel until it makes contact with the board.

16. A rigid water recreation board for towing behind a water vessel comprising:

a board portion;

an eyelet extending through the board portion;

a rope for attachment to the vessel, the rope freely passing through the eyelet;

a handle for attachment to the rope, the handle being dimensioned such that it is larger than the eyelet;

a towing harness for coupling the rope and board portion together in a configuration which minimizes downward diving of the board when there is no rider present on the board portion;

wherein said towing harness interconnects said rope, said handle, and said board in a configuration which ensures that at least a portion of the rope or towing harness engages the upper generally flat surface and the lower surface of the board at the front end of the board.

17. The water recreation board according to claim 16, wherein the board portion further comprises:

a generally flat upper surface;

an upper peripheral edge surrounding the upper surface;

a lower surface;

a lower peripheral edge surrounding the lower surface, the lower peripheral edge being joined to the upper peripheral edge; and an upward-turning lip integrated into the lower surface, the lip being located at a forward end of the board.

18. The water recreation board according to claim 16, wherein the board is made from polyethylene.

19. The water recreation board according to claim 16, wherein the upper surface has a rough finish and the lower surface has a smooth finish.

20. The water recreation board according to claim 17, further comprising:

a thin sheet of smooth polyethylene adhered to the lower surface of the board; and the polyethylene sheet being further adhered to the lip.

21. The water recreation board according to claim 17, wherein the upper surface is concave.

22. The water recreation board according to claim 17, wherein a rider of the board may lie upon, kneel upon, sit upon, or stand upon the board as it is being towed by the vessel, the rider having an option of holding onto the handle or letting the handle be pulled by the vessel against the upper surface while the board is in tow by the vessel.

23. The water recreation board according to claim 16, wherein the board is operable in at least the following modes of operation:

(a) a first prone mode, wherein a user lies face down on the board portion, the user further holding onto the handle;

(b) a second prone mode, wherein the user lies face down on the board portion, the user further allowing the handle to be pulled by the vessel until it makes contact with the board portion;

(c) a first kneeling mode, wherein a user kneels on the board portion, the user further holding onto the handle;

(d) a second kneeling mode, wherein the user kneels on the board portion, the user further allowing the handle to be pulled by the vessel until it makes contact with the board portion;

(e) a first sitting mode, wherein a user sits on the board portion, the user further holding onto the handle;

(f) a second sitting mode, wherein the user sits on the board portion, the user further allowing the handle to be pulled by the vessel until it makes contact with the board portion;

(g) a first standing mode, wherein a user stands on the board portion, the user further holding onto the handle; and (h) a second standing mode, wherein the user stands on the board portion, the user further allowing the handle to be pulled by the vessel until it makes contact with the board portion.

24. A water recreation board according to claim 16, wherein said towing harness includes a first segment which passes under the board through the eyelet and is coupled to said handle and a second segment which passes over the front end of the board and is coupled to said handle.

25. A rigid water recreation board for towing behind a water vessel comprising:

a board portion;

an eyelet extending through the board portion;

a rope for attachment to the vessel, the rope freely passing through the eyelet;

a handle for attachment to the rope, the handle being dimensioned such that it is larger than the eyelet;

a towing harness for coupling the rope and board portion together in a configuration which minimizes downward diving of the board when there is no rider present on the board portion;

wherein said towing harness includes a first segment which passes under the board through the eyelet and is coupled to said handle and a second segment which passes over the front end of the board and is coupled to said handle.

26. The water recreation board according to claim 25, wherein the board portion further comprises:

a generally flat upper surface;

an upper peripheral edge surrounding the upper surface;

a lower surface;

a lower peripheral edge surrounding the lower surface, the lower peripheral edge being joined to the upper peripheral edge; and an upward turning lip intergrated into the lower surface, the lip being located at a forward end of the board.

27. The water recreation board according to claim 25, wherein the board is made from polyethylene.

28. The water recreation board according to claim 25, wherein the upper surface has a rough finish and the lower surface has a smooth finish.

29. The water recreation board according to claim 26, further comprising:

a thin sheet of smooth polyethylene adhered to the lower surface of the board; and the polyethylene sheet being further adhered to the lip.

30. the water recreation board according to claim 26, wherein the upper surface is concave.

31. The water recreation board according to claim 26, wherein a rider of the board may lie upon, kneel upon, sit upon, or stand upon the board as it is being towed by the vessel, the rider having an option of holding onto the handle or letting the handle be pulled by the vessel against the upper surface while the board is in tow by the vessel.

32. The water recreation board according to claim 25, wherein the board is operable in at least the following modes of operation:

(a) a first prone mode, wherein a user lies face down on the board portion, the user further holding onto the handle;

(b) a second prone mode, wherein the user lies face down on the board portion, the user further allowing the handle to be pulled by the vessel until it makes contact with the board portion;

(c) a first kneeling mode, wherein a user kneels on the board portion, the user further holding onto the handle;

(d) a second kneeling mode, wherein the user kneel on the board portion, he user further allowing the handle to be pulled by the vessel until it makes contact with the board portion;

(e) a first sitting mode, wherein a user sits on the board portion, the user further holding onto the handle;

(f) a second sitting mode, wherein the user sits on the board portion, the user further allowing the handle to be pulled by the vessel until it makes contact with the board portion;

(g) a first standing mode, wherein a user stands on the board portion, the user further holding onto the handle; and (h) a second standing mode, wherein the user stands on the board portion, the user further allowing the handle to be pulled by the vessel until it makes contact with the board portion.

* * * * *